US007882903B2

(12) United States Patent
Barnett

(10) Patent No.: US 7,882,903 B2
(45) Date of Patent: Feb. 8, 2011

(54) CUTTINGS BED REMOVAL TOOL

(75) Inventor: Robert Barnett, Calgary (CA)

(73) Assignee: BBJ Tools Inc., Calgary (CA)

( * ) Notice: Subject to any disclaimer, the term of this patent is extended or adjusted under 35 U.S.C. 154(b) by 207 days.

(21) Appl. No.: 11/752,052

(22) Filed: May 22, 2007

(65) Prior Publication Data

US 2007/0278011 A1 Dec. 6, 2007

Related U.S. Application Data

(60) Provisional application No. 60/803,483, filed on May 30, 2006.

(51) Int. Cl.
*E21B 21/00* (2006.01)

(52) U.S. Cl. ..... 175/65; 175/207; 166/311

(58) Field of Classification Search ..... 166/312, 166/170, 173, 202, 99; 175/230
See application file for complete search history.

(56) References Cited

U.S. PATENT DOCUMENTS 4,111,262 A * 9/1978 Duncan ..... 166/99
4,921,046 A * 5/1990 Caskey ..... 166/170
6,176,311 B1 * 1/2001 Ryan ..... 166/99
6,223,840 B1 5/2001 Swietlik
6,227,291 B1 5/2001 Carmichael et al.
6,523,612 B2 2/2003 Reynolds
6,732,821 B2 5/2004 Boulet
6,840,337 B2 1/2005 Terry et al.
6,951,251 B2 * 10/2005 Penisson ..... 166/312
7,051,821 B2 5/2006 Samuel
7,159,668 B2 1/2007 Herrera
7,174,958 B2 2/2007 Appleton
2002/0033266 A1 * 3/2002 Hester et al. ..... 166/369
2006/0086507 A1 * 4/2006 Surjaatmadja et al. ..... 166/312
2006/0144620 A1 * 7/2006 Cooper et al. ..... 175/57
2007/0044958 A1 * 3/2007 Rytlewski et al. ..... 166/250.01

* cited by examiner

*Primary Examiner*—Kenneth Thompson
*Assistant Examiner*—James G Sayre
(74) *Attorney, Agent, or Firm*—Bennett Jones LLP

(57) ABSTRACT

A cuttings bed removal tool for use on a drill string in a well bore includes: a sub having a region of enlarged outer diameter over the string diameters indicated by its upper end connection and an indicator disposed downhole of the region of enlarged outer diameter and having at least one bypass port extending through the indicator to permit passage of fluid in an upward direction through the indicator.

19 Claims, 4 Drawing Sheets

CUTTINGS BED REMOVAL TOOL

FIELD OF THE INVENTION

The present invention relates to the removal of debris from wells drilled in geological formations.

BACKGROUND

While one of the functions of circulating drilling fluid during the drilling of a well is to prevent drill cuttings from accumulating in the borehole by carrying them to the surface, such circulation may not completely remove all such cuttings (and other debris) from the borehole. Moreover, the conventional circulation of drilling fluid during drilling is particularly inefficient for cleaning out drill cuttings in many high-angle and horizontal wells, sometimes resulting in the formation of a layer of drill cuttings and other solids settling along the low side of the high angle and horizontal drill sections; this is sometimes known as a cuttings bed. The formation of a cuttings bed can cause additional difficulties, for example, by causing increased torque and drag on the drill string.

SUMMARY

In the following description of the invention, it is to be understood that although the reference is made to a borehole and/or well bore and the wall of the borehole and/or well bore, it is to be understood that the borehole could be open hole or lined. For example, the terms borehole/well bore have been used to include open holes, cased boreholes and the term borehole wall in that case would actually be the inner surface of an open borehole wall and any casing or other liner lining the well bore.

In one aspect of the invention, there is provided a cuttings bed removal tool for use on a tubular string in a well bore, comprising: a sub having a region of enlarged outer diameter over the string diameters indicated by its upper end connection and an indicator disposed downhole of the region of enlarged outer diameter and having at least one bypass port extending through the indicator to permit passage of fluid in an upward direction through the indicator.

In another aspect of the invention, there is provided a cuttings bed removal system for use in a well bore, comprising: a tubular string including a maximum outer diameter and including a sub having a region of enlarged diameter greater than the maximum outer diameter of the tubular string; and, an indicator disposed about the tubular string downhole of the region of enlarged diameter and having at least one by pass port extending through the indicator.

In another aspect of the invention, there is provided a cuttings bed removal system for use in a well bore, the system including a drill string including a sub having an annular volume restriction region and an indicator disposed about the drill string downhole of the annular volume restriction region and having at least one lateral channel extending therethrough.

In yet another aspect of the invention, there is provided a method of reducing a cuttings bed, comprising: inserting a tubular string from surface into a well bore, thereby defining an annulus between the tubular string and the well bore, the tubular string including inner bore, a sub forming an annular restriction region thereabout, and an indicator disposed downhole of the annular restriction region, the indicator having at least one bypass port extending through the indicator; running the tubular string to a selected depth; and, pumping fluid through the tubular string inner bore and into the wellbore annulus, circulating the fluid in the wellbore annulus from below the indicator, through the indicator bypass ports, and past the sub to surface. The method may further include the steps of retrieving and inspecting the indicator to determine whether sufficient cuttings remain to repeat the steps.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

A cuttings bed removal tool of the invention may be used to remove waste solids such as cuttings and other debris collected on the low side of a drill section. Such removal may be accomplished by drilling fluid agitation caused by the tool and physical contact of the tool with the waste solids to urge them away from the cuttings bed and out of the borehole.

In operation, drilling fluid may be pumped down through a string into which the tool is installed and into the wellbore. The string may be a work string or a drill string and the fluid may be released into the wellbore through a port in a sub or out through the drill bit. The drilling fluid then passes up the borehole annulus between the string and the wellbore wall. As the drilling fluid passes the tool, an annular volume restriction region on the tool reduces the annular flow area about the tool and causes the annular velocity of the drilling fluid flowing back up the borehole annulus to be increased and, thereby, urges loose the cuttings bed. The tool further includes a ported indicator formed at least in part of a deteriorable material. Remaining debris on the cuttings bed may contact the indicator as the tool is drawn uphole causing the indicator to travel along the cuttings bed; if any such debris does remain, contact with the indicator may result in visible deterioration of the indicator such that viewing the indicator upon removal of the tool may provide the user with some indication of the state of the cuttings bed.

Figure 1:
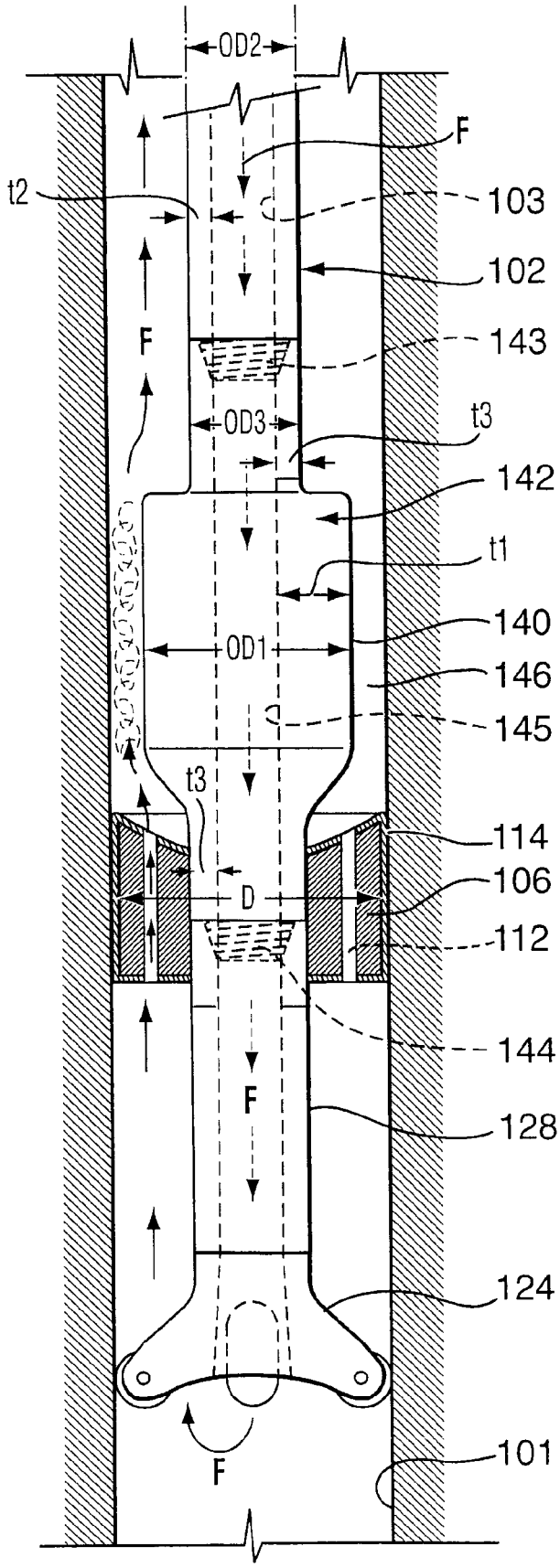
FIG. 1 is a schematic illustration of a borehole including an assembly for reducing a cuttings bed.

Referring to the embodiment shown in FIG. 1, tool 100 includes a sub 142 for installation into a string such as a drill string 102. Tool 100 may include for example, an upper connection 143 and a lower connection 144 for installation, as by threaded connection, directly or indirectly into the string. Tool 100 may be incorporated into drill string 102 and connected uphole of a drill bit 124, and, as shown in FIG. 1, it may include or operate with a bottom sub 128 for connecting to drill bit 124. However, it is to be understood that the tool of the invention is not limited to requiring a bottom sub, sub 142 being able to connect directly to the drill bit or other structures therebelow or may have an end intended to be the lower limit of the string.

Tool 100 includes an inner bore 145 extending axially from upper connection 143 and in the illustrated embodiment extending to lower connection 144, the inner bore being positioned to place the tool into communication with the inner bore 103 of the string to which it is attached. As such, fluid, arrows F, pumped through drill string 102 can pass into and through tool 100 via its bore 145. Inner bore 145 in the illustrated embodiment extends through the tool from end to end so that fluid can pass therethrough into the drill bit connected therebelow. It is to be understood that the tool lower end could represent the lower limit of the string and bore 145 could be open at the tool's lower end or the lower end could include ports in communication with bore 145 to allow fluid to pass therethrough into the wellbore 101.

Tool 100 includes an enlarged region 140 on its outer surface that creates an annular volume restriction, indicated at 146, between region 140 and the wellbore wall, compared to the annular volume between the drill string and the wellbore wall, when the tool and string are positioned in the wellbore.

Tool 100 further includes an indicator 106 having at least one port 112 therethrough to allow passage of fluid and cuttings in at least the uphole direction, toward upper connection 143. The indicator may be installed in various ways to act in the annulus about the tool or the drill string adjacent the tool. For example, in the embodiment shown in FIG. 1, indicator 106 is fixed downhole of enlarged region 140. In FIG. 1, indicator is secured in a manner to prevent displacement and in a position about a connection between bottom sub 128 and sub 142. In some embodiments, the ported indicator may be disposed about the tool sub defining enlarged region 140, and that sub may itself directly connect to the drill bit. In further alternative embodiments, instead of being disposed about a sub, the ported indicator may connect at its uphole end to the downhole end of the top sub, and at its downhole end either to the drill bit or to a another structure below tool 100.

Enlarged region 140 of the tool has an outer diameter OD1 less than the inner diameter of borehole 101 in which the tool is intended to be used such that fluid can flow therepast in the annular area around the enlarged region and the borehole. However, OD1 is greater than the average and in some embodiments the maximum outer diameter OD2 of the string with which the tool is intended to be used. As will be appreciated, a drill string generally includes connections sized with consideration as to the outer diameter OD2 of the string. At least upper connection 143 may be sized to correspond to the outer diameter OD2 of the drill string with which the tool is to be used. In particular, the size of upper connection 143 may be selected to correspond and connect to a tubular of diameter less than that diameter OD1 of region 140. In the illustrated embodiment, lower connection 144 also is sized to correspond and connect to a tubular of outer diameter less than that diameter OD1 of region 140. The ends of the tool adjacent to connections 143, 144 may have an outer diameter OD3 that substantially corresponds with that OD2 of the drill string to which the tool is intended to be connected. In such a tool, the ends of the tool have an outer diameter OD3 less than the outer diameter OD1 at region 140.

Region 140 may be formed in various ways, as by forming an area of increased wall thickness on the tool. For example, maximum wall thickness t1 at region 140 may be greater than the maximum wall thickness t2 of the tubulars forming drill string 102 and the maximum wall thickness t3 of the tool ends adjacent connections 143, 144.

The enlarged region of the tool, when placed adjacent to the cuttings bed and in operation, causes an increase in the annular velocity of fluid passing between the region and the borehole wall, which in turn scours the cuttings bed.

Figure 5A:
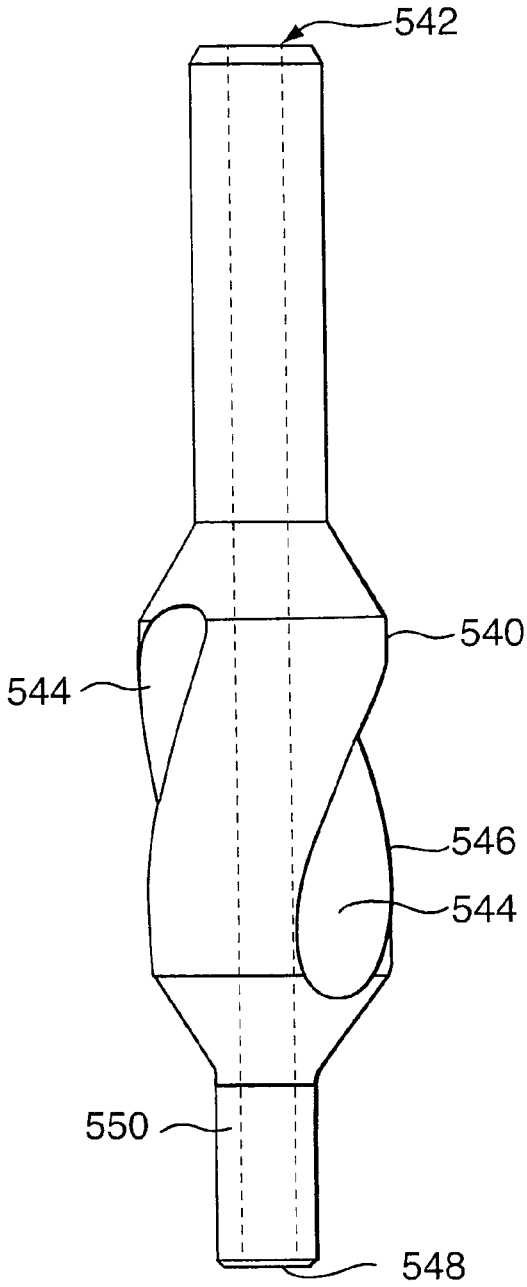
FIG. 5*a* is a side view of a top sub of an embodiment of a tool of the invention.
Figure 5B:
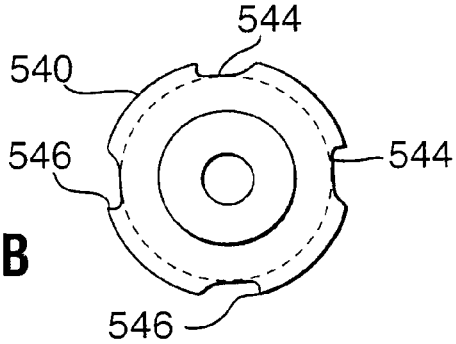
FIG. 5*b* is a top plan view of the sub of FIG. 5*a*.

Referring to the embodiment shown in FIGS. 5*a* and 5*b*, top sub 542 includes oversize region 540 disposed adjacently upstream of a region 550 where ported indicator body is to be attached, which is in turn adjacent to the tool's bottom end 548. In some embodiments, the top sub may be further provided with cutting edges for scraping away the cuttings bed, in circumstances where the cuttings bed is thick enough to come into contact with the oversize region. Such cutting edges may be provided by forming grooves in the oversize region or, in reverse, forming raised cutting extensions (such as inverted stabilizers). Such cutting edges may be disposed substantially longitudinally, substantially transversely, or substantially spirally about the oversize region. In addition, to further increase cuttings bed removal effectiveness, the annular volume restriction sub may be rotatable about its longitudinal axis. For example, as shown in FIG. 5, top sub 542 is rotatable such as by rotation of the drill string in which it is installed and includes spiral channels 544 on oversize region 540, and leading edges 546 on the raised portion between channels 544 may function as cutting edges. Leading edges 546 may be sharpened, hardened, undercut, etc. to enhance their cutting and/or abrasive properties. Leading edges 546 may be formed on one or both sides of groove, but in the illustrated embodiment are formed on the side of the groove which will have the greatest contact with the formation with consideration as to the usual direction of rotation (i.e. normally right hand rotation when viewed from above) of the drill string.

Figure 2A:
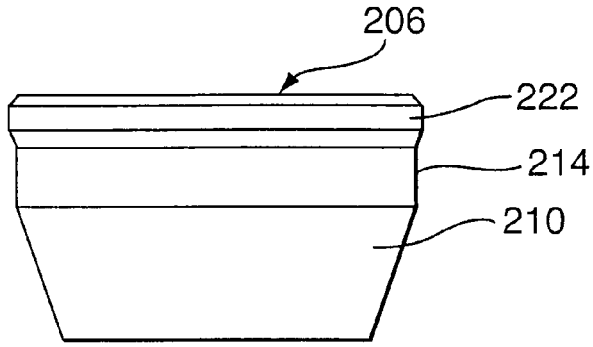
FIG. 2*a* is side view of a ported indicator body of an embodiment of the invention.

In accordance with the invention, the indicator is provided with at least one passage or port to allow the flow of fluid from downhole upwardly past the outer surface of enlarged region 140 to convey debris from the cuttings bed, and then uphole. The number and size of passages or ports may be selected depending on the diameter and composition of the indicator, the desired flow rate past the indicator and/or the size of the cuttings of the cuttings bed, as would be known by consideration of the drilling and/or borehole parameters. The ports may be sized to permit passage therethrough of the cuttings. The flow rate that is effective to scour the cuttings bed may depend on factors such as the viscosity of the fluid used, the mass of the cuttings, the size of the borehole, etc., which would be understood by one skilled in the art. For example, in some conditions, a flow rate of 2 $m^3$/min to 3 $m^3$/min may be effective for a 13⅜ inch casing. In the embodiment shown in FIGS. 2*a* and 2*b*, indicator 206 may be used in high flow rate conditions, having as it does six ports 212 of a selected size; if fewer ports were desired, then, in order to maintain a similar flow rate without causing back pressure to be exerted upon the formation, the size of the ports should be increased. In practical terms, the size, shape, and number of ports may be limited by the diameter and composition of the indicator. In addition, for embodiments of the invention that include oversize sub cutting edges, the oversize sub channels defined thereby may also be factors in considering size and number of indicator ports. For example, if the area defined by the total of the ports is less than the total annular area defined between the oversize region and the wellbore diameter in which it is intended to be used, then there may be an issue of back pressure being exerted upon the formation. In addition, if the area defined by the ports is less than the annular area defined by the channels and oversize region, then the annular velocity of the fluid flow would be reduced with a resulting reduction of the scouring effect.

Figure 2B:
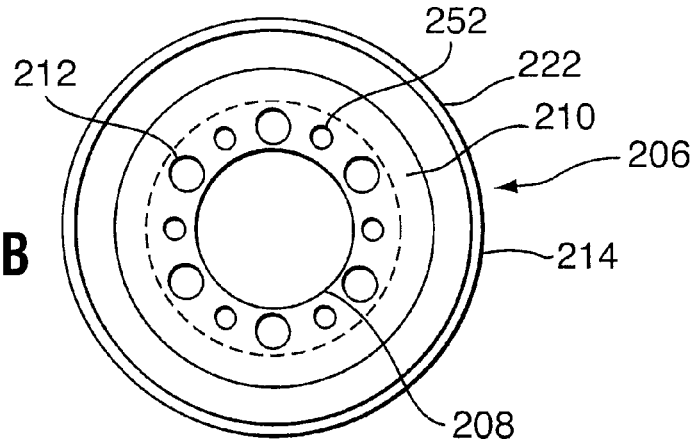
FIG. 2*b* is a bottom plan view of the ported indicator body of FIG. 2*a*.
Figure 3A:
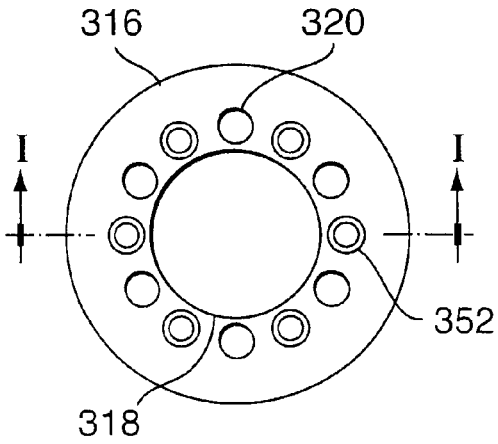
FIG. 3*a* is a side view of an indicator mount of an embodiment of the invention.
Figure 3B:
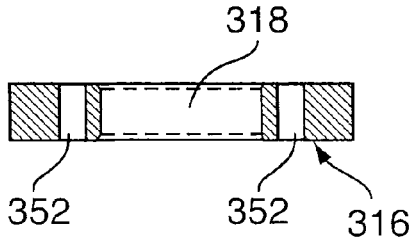
FIG. 3*b* is a cross-section along line I-I of the indicator mount of FIG. 3*a*.
Figure 4:
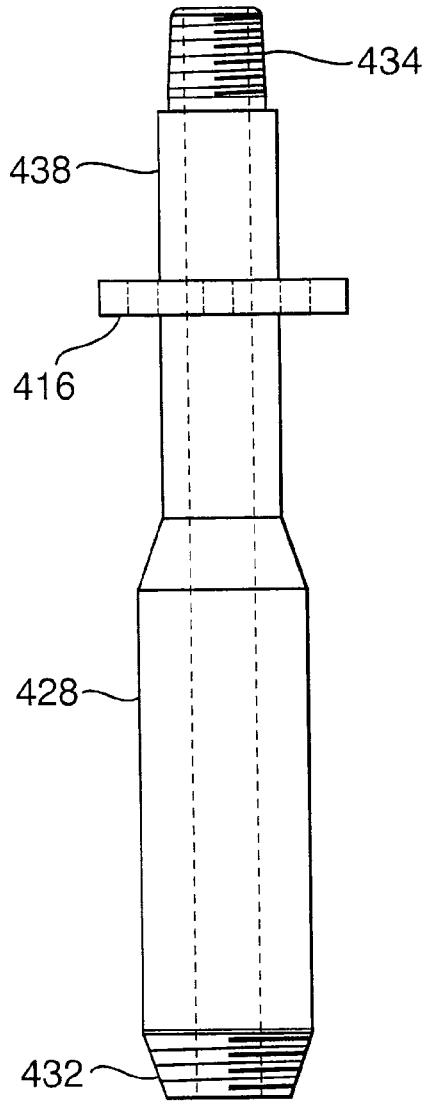
FIG. 4 is a side view of an assembly including a bottom sub and ported indicator mounting flange of an embodiment of the invention.

In various embodiments, the indicator may be secured about the tool or a drill string sub by use of an indicator mount, including at least one port corresponding to and to be aligned with at least one of the indicator ports. Referring to FIGS. 2 and 3, indicator 206 and indicator mount 316 may be provided with apertures 252 and 352, respectively, for accepting fasteners, such as bolts, for joining the two parts. It is to be understood that the engagement of the indicator and the indicator mount may be achieved in many ways (and indeed in some embodiments these parts may comprise a single integral unit). In embodiments such as that shown in FIGS. 2 and 3 these attachment points may include such attachments as weld points, threaded bores, etc. Further, while the illustrated indicator mount 316 comprises a rigid ported flange having an outside diameter substantially less than the diameter of indicator edge 222, it is to be understood that in some embodiments the indicator mount may be similarly dimensioned to the indicator edge, if it is desired to utilize the indicator mount as a means for engaging against and displacing cuttings from the cuttings bed. In addition, while indicator mount 316 includes ports 320 alignable with ports 212 on indicator body, it is to be understood that it is not necessary to have a one-to-one correlation of such ports. In embodiments such as that shown in part in FIG. 4, indicator mount 416 may be attached (such as by welding, threading, etc.) onto bottom sub 428, with bottom sub region 438 being provided as a base for the ported indicator body (not shown). For this purpose, in embodiments having separately-formed indicator mounts for engagement to a sub such as is shown in FIGS. 3*a* and 3*b*, mount 316 is provided with a central aperture 318 having an internal diameter corresponding to the external diameter of the region of such a sub upon which the mount is to be attached. Similarly, referring back to FIG. 2*b*, indicator 206 is provided with a corresponding central channel 208. Of course, in some embodiments, the tool may include an integrally-formed indicator. In various embodiments, the bottom sub may be sized and configured for the drill bit in use including, by way of example, being provided with a connector and having appropriate dimensions for accommodating connection to the drill bit; for embodiments such as that shown in part in FIG. 4, bottom sub 428 may be provided with threaded connector 432 for attaching to the drill bit having a complementary threaded connection (not shown). The bottom sub may also be provided with a connector element for connecting to the top sub; for example, bottom sub 428 in FIG. 4 is provided with a connector element 434 for connection to the top sub (not shown).

In operation, contact of the indicator with the cuttings bed may result in visible changes to the surface of the indicator. Referring back to FIG. 1, the tool 100 includes a ported indicator 106 for mounting on a drill string 102 uphole of a drill bit 124. Indicator 106 includes at least one port 112 and is attached to drill string 102. The diameter D of indicator 106 is selected to be small enough to fit within the borehole 101 and large enough that outer surface 114 may contact solid debris on the cuttings bed when it is run down to the depth of the cuttings bed; for compressible indicators, this may mean that the diameter D of the indicator may be about the same as the diameter of the borehole in which it is intended to be used (or, for those indicators that can be sufficiently compressed to fit into the borehole, diameter D may be even slightly greater than the diameter of the borehole), whereas non-compressible indicators may require a diameter slightly less than that of the borehole in which the tool is intended to be used. In order to provide the indication function, at least some portion of outer surface 114 includes material selected to deteriorate with suitable abrasive contact, as would occur when the ported indicator comes into contact with the cuttings bed. While in some embodiments it may be desirable that the outer surface of the ported indicator may be deteriorable, sufficiently flexible that it can be fairly easily unstuck from the borehole, yet sufficiently rigid to cause displacement of cuttings bed solids as the ported indicator is run along the cuttings bed, it is up to the user whether or not the entire ported indicator should be constructed of the same material. For example, referring to FIG. 2, the indicator 206 may include central channel 208 (to accommodate a drill string), body 210 having ports 212, and edge 222 (at which the diameter of the indicator is at its greatest) of outer surface 214, all of which may be constructed of a suitable material that is both deteriorable yet rigid enough that it may apply a dislodging force to settled debris with which at least edge 222 comes into contact during movement of the tool. Edge 222 may be annular such that the entire of circumference of the borehole may be checked with one pass of the indicator. For example, without limitation, an indicator may include a painted surface from which paint will be abraded by contact with the cuttings bed. In another example, without limitation, the indicator may include such components as a synthetic or natural rubber or polymeric swab cup (also called a packer cup); using this example, while the rubber of the swab cup indicator outer surface could be scratched, torn, or otherwise damaged by contact with cuttings on the cuttings bed, it is also sufficiently rigid to possibly urge such debris away from the cuttings bed as the outer surface travels along the cuttings bed but can be dislodged relatively easily should it become stuck in the hole. Of course, depending on the thickness of the cuttings bed, the diameter of the indicator body and the material(s) from which it is composed, the body may come into contact with the debris and may similarly urge away the cuttings and/or be damaged by such contact. In some embodiments, a second edge, comprising a rigid and more durable material, may be provided between the first edge and region 140 to scrapingly dislodge cuttings from the cuttings bed. Such a second edge may, by way of example, comprise a steel flange. Such a second edge may be provided on the indicator or as a part on the tool adjacent the indicator but spaced from the indicator.

Figure 6:
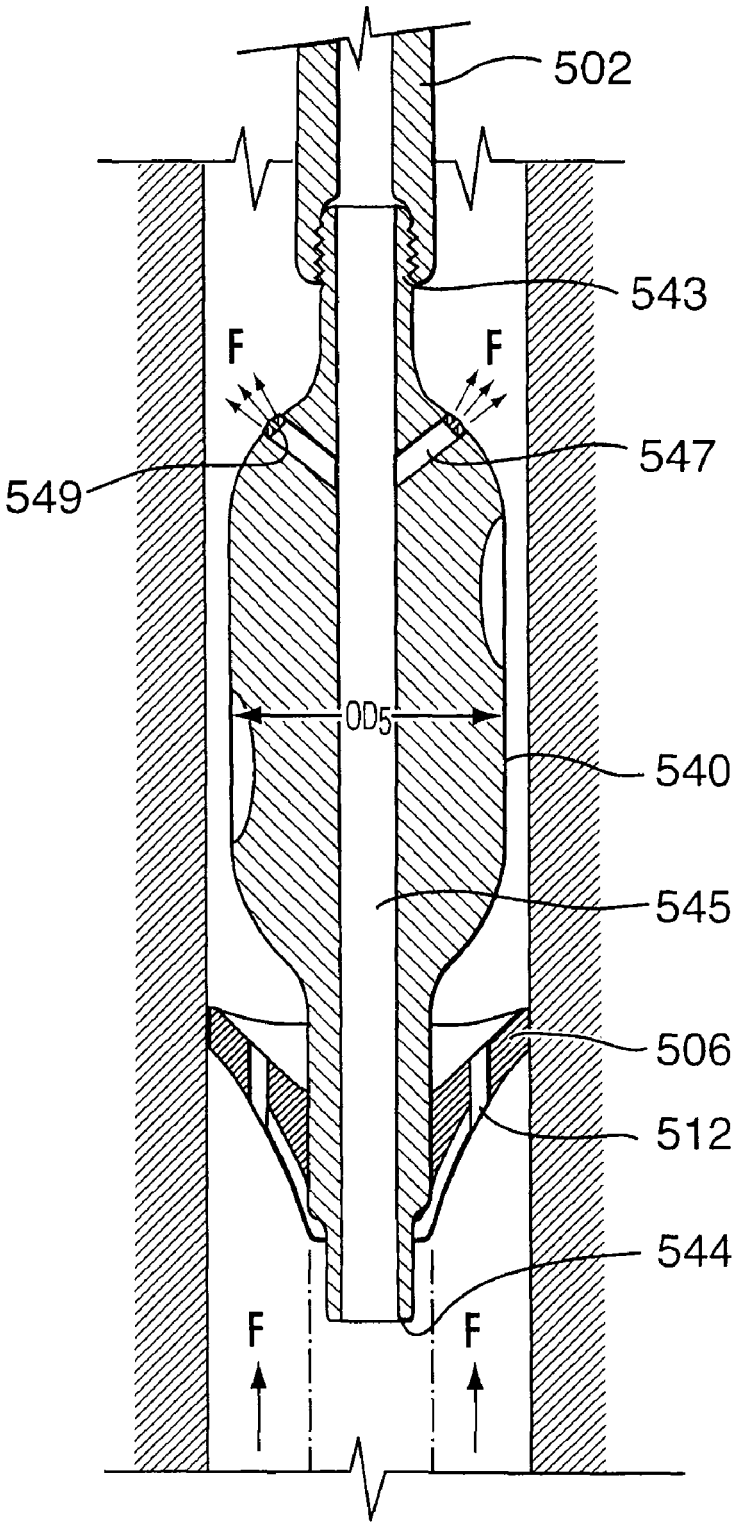
FIG. 6 is an axial section along the length of a borehole including a tool according to one aspect of the present invention.

Another cuttings bed removal tool is shown in FIG. 6 including an upper end 543 and a lower end 544 and an enlarged region 540 therebetween. Enlarged region 540 includes an outer diameter OD5 that is larger than the maximum outer diameter of the string 502 to which it is to be attached during use. The tool of FIG. 6 further includes an indicator extension 506 including ports 512 therethrough. The tool further includes an inner longitudinal bore 545 that extends from the upper end to the lower end to permit fluid flow through the tool from the upper end out of the lower end. In the illustrated embodiment, one or more fluid outlets 547 are provided laterally from inner bore 545 through body to the tool's outer surface. Two such fluid outlets 547 are shown in FIG. 6. Such fluid outlets may extend to open on outer surface between the lower end of region 540 and upper end 543. In the illustrated embodiment, for example, outlets 547 open between the area of maximum outer diameter of region 540 and upper end 543 and in particular on a shoulder between end 543 and region 540. Outlets 547 may be angled to discharge fluid therethrough in a direction toward upper end, which in use will be an uphole direction. Outlets 547 may include nozzles 549 such that fluid discharged therethrough tends to jet with force therethrough. As such, fluid discharged through outlets 547 may apply a jetting force. Such a tool may be useful in holes where an extra jetting force, in addition to fluid circulation upwardly from below indicator extension 506, may be desired to remove the cuttings bed.

While the illustrated embodiments disclose the engagement of the ported indicator about the subs, it is to be understood that the ported indicator itself may comprise a sub being bracketed between upper and lower subs. Such a ported indicator sub may be provided with connector elements with which it may attach to such upper and lower subs.

Of course, it is to be understood that the cuttings bed removal tool may be formed in other ways. While the embodiments of FIGS. 1 to 5 illustrate that the tool may be formed in sections that are connected together such as by the threaded connections to facilitate manufacture and assembly, other connections (such as welded connections, etc.) could be used, or the tool could have a unitary construction such as that shown in FIG. 6.

In an embodiment of the method of the invention, the tool is made up and run in to the top of the cuttings bed. The borehole may be previously drilled, the drill sting removed and then another string including a tool according to the present invention run into the hole. In some embodiments, the exact location of the cuttings bed may not be positively known, but may be estimated or determined from the angle/trajectory of the well. At the upper end of the cuttings bed, if drilling fluid is not already being circulated through the tool, circulation of drilling fluid is begun and the tool is worked down through the cuttings bed to a desired depth. At a desired depth the tool has passed down through at least a portion of a cuttings bed and disrupted the bed such that at least some of the cuttings have been moved with the circulating fluid uphole of the tool. To most rapidly clear the cuttings bed, the circulation rate should be as high as possible while trying to avoid problematic well conditions, such as, for example, the generation of a back pressure issue. As the drilling fluid continues to be circulated, the tool is then slowly pulled back up towards surface such as to the depth previously believed to be the top of the cuttings bed. The drilling fluid continues to be circulated at this depth until the hole above the tool is substantially clear of drill cuttings. Depending on the length of the cuttings bed, it may be necessary to repeat this procedure over several depths to clean out the borehole in a stepwise fashion; alternatively, the procedure may be repeated several times over the entire length of the cuttings bed to achieve this purpose. In some embodiments, the tool may be pulled to surface while circulating to urge the cuttings along the well. As a check, the tool may be pulled to surface to examine the indicator for damage or wear thereto as would be caused by existence of cuttings bed over which the outer edges of the indicator have passed, which are those cuttings not conveyed with the fluid through the indicator ports and/or those not conveyed past the enlarged region. Of course, it is to be understood that embodiments of the method of the invention are not limited to the apparatus illustrated in these figures.

Another embodiment of the inventive method may include the following, repeated as necessary to achieve the desired reduction of the cuttings bed:

(a) inserting a string from surface into a well bore, thereby defining an annulus between the drill string and the well bore, the drill string including a drill string inner bore, a sub having an enlarged region forming an annular restriction around the sub, and an indicator disposed downhole of the enlarged region, the indicator having at least bypass port extending through the indicator;

(b) running the string to a selected depth, such as a depth at which it is suspected that at least a portion of a cuttings bed is located uphole of the ported indicator. While running through the cuttings bed, a drill bit may be operated/rotated to disrupt the cuttings bed and/or fluid circulation may be carried out to move the cuttings up through the ports of the indicator; and, (c) pumping fluid through the string inner bore and into the wellbore annulus, so that fluid is circulated in the wellbore annulus from below the indicator, through the indicator ports, and past the sub to surface. The circulation may be continued as the tool is pulled to surface to move cuttings ahead/uphole of it substantially without settling. Using a tool such as that of FIG. 6, pumping fluid also discharges fluid though the lateral outlets above the enlarged region. Such laterally directed fluid may act to jet out debris from the crevices of borehole wall.

Cuttings carried to surface by the circulating fluid may be disposed (such as into a shale bin) or subjected to whatever processing may be desired.

In addition, some embodiments of the method of the invention may include the further step of retrieving the tool to the surface and visually inspecting it to determine whether the indicator was damaged by cuttings during such retrieval and thus whether enough of a cuttings bed remains to justify repeating the method. In various embodiments, the drill bit may also be used to loosen the accumulated cuttings sufficiently to allow the tool to be brought down to the desired depth.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A cuttings bed removal system for use in a well bore, comprising:

(a) a tubular string including a maximum outer diameter and including a sub having a region of enlarged diameter with a diameter greater than the maximum outer diameter of the tubular string, the region of enlarged diameter forming a solid outer surface such that fluid passing upwardly about the tool is forced to move past the solid outer surface and the solid outer surface including cutting edges formed thereon; and, (b) a cup packer disposed about the tubular string downhole of the region of enlarged diameter, the cup packer being disposed to open upwardly toward the region of enlarged diameter and having at least one by pass port extending therethrough.

2. The cuttings bed removal system of claim 1 further comprising:

an inner bore through the sub;

a fluid outlet from the inner bore below the cup packer; and a fluid discharge outlet from the inner bore above a lower limit of the region of enlarged diameter.

3. A method of reducing a cuttings bed, comprising:

(a) inserting a tubular string from surface into a well bore, thereby defining an annulus between the tubular string and the well bore, the tubular string including an inner bore, a sub forming an annular restriction region thereabout, and a cup packer disposed downhole of the annular restriction region, the cup packer including an annular lip opening upwardly toward the annular restriction region and having at least one bypass port extending through the cup packer;

(b) running the tubular string to a selected depth to move the cup packer and sub to a position below the cuttings bed;

(c) pumping fluid through the tubular string inner bore and into the wellbore annulus, circulating the fluid in the wellbore annulus from below the cup packer, through the at least one bypass port of the cup packer, and past the sub through the annular restriction region to surface; and (d) while pumping fluid, pulling the cup packer and the sub up through the well bore toward surface.

4. The method of claim 3 further comprising, while pulling the cup packer and the sub, moving the tubular string to drive the annular lip of the cup packer against the cuttings bed.

5. The method of claim 3 further comprising, while pulling the cup packer and the sub, rotating the sub to cut into the cuttings bed.

6. The method of claim 3, further comprising retrieving the system to surface and inspecting the cup packer for abrasive wear.

7. The method of claim 3 further comprising discharging fluid from the inner bore uphole of the sub through lateral discharge outlets.

8. A cuttings bed removal system for use in a well bore, comprising:

(a) a tubular string including a maximum outer diameter and including a sub having a region of enlarged diameter with a diameter greater than the maximum outer diameter of the tubular string, the region of enlarged diameter forming a solid outer surface such that fluid passing upwardly about the tool is forced to move past the solid outer surface and the solid outer surface including cutting edges formed thereon; and, (b) a packer cup disposed about the tubular string downhole of the region of enlarged diameter, the packer cup being adapted to engage the wellbore during use, disposed to open upwardly toward the region of enlarged diameter and having at least one by pass port extending therethrough.

9. The cuttings bed removal system of claim 8 further comprising:

an inner bore through the sub;

a fluid outlet from the inner bore below the packer cup; and a fluid discharge outlet from the inner bore above a lower limit of the region of enlarged diameter.

10. A method of reducing a cuttings bed, comprising:

(a) inserting a tubular string from surface into a well bore, thereby defining an annulus between the tubular string and the well bore, the tubular string including an inner bore, a sub forming an annular restriction region thereabout, and a packer cup disposed downhole of the annular restriction region, the packer cup including an annular lip opening upwardly toward the annular restriction region and having at least one bypass port extending through the packer cup, during inserting, the packer cup being compressed to fit into the well bore;

(b) running the tubular string to a selected depth to move the packer cup and the sub to a position below the cuttings bed;

(c) pumping fluid through the tubular string inner bore and into the wellbore annulus, circulating the fluid in the wellbore annulus from below the packer cup, through the at least one bypass port of the packer cup, and past the sub through the annular restriction region to surface; and (d) while pumping fluid, pulling the packer cup and the sub up through the well bore toward surface.

11. The method of claim 10 further comprising, while pulling the packer cup and the sub, moving the tubular string to drive the annular lip of the packer cup against the cuttings bed.

12. The method of claim 10 further comprising, while pulling the packer cup and the sub, rotating the sub to cut into the cuttings bed.

13. The method of claim 10, further comprising retrieving the system to surface and inspecting the packer cup for abrasive wear.

14. The method of claim 10 further comprising discharging fluid from the inner bore uphole of the sub through lateral discharge outlets.

15. A method of reducing a cuttings bed, comprising:

(a) inserting a tubular string from surface into a well bore, thereby defining an annulus between the tubular string and the well bore, the tubular string including an inner bore, a sub forming an annular restriction region thereabout, and a packer cup disposed downhole of the annular restriction region, the packer cup including an annular lip opening upwardly toward the annular restriction region and having at least one open bypass port extending through the packer cup being open to fluid flow therethrough;

(b) running the tubular string to a selected depth to move the packer cup and the sub to a position below the cuttings bed;

(c) pumping fluid through the tubular string inner bore and into the wellbore annulus, circulating the fluid in the wellbore annulus from below the packer cup, through the at least one open bypass port of the packer cup, and past the sub through the annular restriction region to surface; and (d) while pumping fluid, pulling the packer cup and the sub up through the well bore toward surface.

16. The method of claim 15 further comprising, while pulling the packer cup and the sub, moving the tubular string to drive the annular lip of the packer cup against the cuttings bed.

17. The method of claim 15 further comprising, while pulling the packer cup and the sub, rotating the sub to cut into the cuttings bed.

18. The method of claim 15, further comprising retrieving the system to surface and inspecting the packer cup for abrasive wear.

19. The method of claim 15 further comprising discharging fluid from the inner bore uphole of the sub through lateral discharge outlets.

* * * * *